US005671501A

United States Patent [19]

Laramie

[11] Patent Number: 5,671,501

[45] Date of Patent: Sep. 30, 1997

[54] SELF CLEANING SLIDING DOOR BOTTOM TRACK ASSEMBLY

[76] Inventor: Abraham J. Laramie, 2817 Oak Lynn Ave., Apt. A, Eustis, Fla. 32726-6531

[21] Appl. No.: 656,831

[22] Filed: Jun. 3, 1996

[51] Int. Cl.[6] ..... A47H 15/00

[52] U.S. Cl. ..... 16/96 R

[58] Field of Search ..... 16/96 R, 93 R, 16/94 R, 95 R, 87 R, 87.4 R

[56] References Cited

U.S. PATENT DOCUMENTS

| | | | |
|---|---|---|---|
| 111,342 | 1/1871 | Hamilton | 16/96 R |
| 204,006 | 5/1878 | Condict, Jr. | 16/96 R |
| 713,996 | 11/1902 | Krygoski et al. | 16/96 R |
| 2,856,040 | 10/1958 | Dansereau | 189/46 |
| 2,885,000 | 5/1959 | Merrill | 160/118 |
| 3,384,998 | 5/1968 | Abramson | 49/411 |
| 4,073,035 | 2/1978 | Baus | 16/96 R |
| 4,228,560 | 10/1980 | Baus | 16/90 |
| 4,258,443 | 3/1981 | Baus | 4/557 |
| 4,388,779 | 6/1983 | Brooke | 49/125 |
| 4,392,272 | 7/1983 | Finkel | 16/95 |

FOREIGN PATENT DOCUMENTS

| | | | |
|---|---|---|---|
| 254075 | 7/1963 | Australia | 16/96 R |
| 548541 | 9/1956 | Italy . | |
| 98042 | 5/1961 | Netherlands . | |

*Primary Examiner*—Chuck Y. Mah
*Attorney, Agent, or Firm*—Edward M. Livingston, Esq.

[57] ABSTRACT

A new bottom track assembly for sliding doors such as showers, patios and the like having a plurality of elongated dividers (1) connected and separated by rods (2) at spaced intervals between the dividers (1) to form open tracks (3) between each divider (1). The rods (2) have circular rollers (13) which rotate around the rod when sliding doors are moved between the tracks. This new track assembly allows water and dirt to fall through the dividers, thereby preventing dirt and algae from building up between the tracks, a common problem with conventional track assemblies.

2 Claims, 1 Drawing Sheet

SELF CLEANING SLIDING DOOR BOTTOM TRACK ASSEMBLY

BACKGROUND OF THE INVENTION

This invention relates to sliding doors, particularly bottom guide tracks for shower doors, patio doors and the like.

Conventional bottom guide tracks for sliding doors, such as those used showers and patio doors, have solid bottoms and sidewalls, some of which may contain only small holes for water to drain from the tracks. Thus, water is left in the tracks which causes algae to grow in the tracks. Also, solid bottom tracks allow dirt to be captured and retained in the track. Such dirt and algae results in the growth of bacteria which can lead to disease. Furthermore, algae and dirt is difficult to remove and clean from the tracks. Thus, a need exists for sliding door bottom guide tracks for showers and other uses that eliminates algae and dirt build up and is easier to clean.

The prior art contains various sliding door assemblies, but none like the present invention. For instance, U.S. Pat. No. 2,885,000 issued to Merrill on May 5, 1959, teaches a shower door with drain holes in the walls of the lower track. U.S. Pat. No. 3,384,998 issued to Abramson on May 28, 1968, teaches another shower door with the bottom tract slopes into the tub so that water drains into the tub. U.S. Pat. No. 4,073,035 issued to Baus on Feb. 14, 1978, discloses a lower track for sliding doors where a slanted lower bottom for draining water into the tub. U.S. Pat. No. 4,258,443 issued to Baus on Mar. 31, 1981, teaches another door with lower track for each partition having a bottom which slopes toward the tub. U.S. Pat. No. 4,392,272 issued to Finkel on Jul. 12, 1983, discloses another shower door with a lower track having a slanting bottom for also allowing water to drain into the tub. U.S. Pat. No. 4,388,778 issued to Brooke on Jun. 21, 1983, discloses an enclosure for shower sliding doors and a conventional bottom track. Italy Patent No. 548541 issued Sep. 26, 1956, teaches a shower door track with drain holes in the side. Netherlands Patent No. 98042 discloses a shower door with a bottom track to retain a door. U.S. Pat. No. 2,856,040 issued to Dansereau on Oct. 14, 1958, teaches another shower door enclosure with a lower U-shaped track having drain holes 39 at the bottom. U.S. Pat. No. 4,228,560 issued to Baus on Oct. 21, 1980 teaches yet another shower door lower guide having a swing guide wall to enable easier cleaning of accumulated dirt in the guide.

Although there are numerous lower sliding door track assemblies for sliding shower doors of various designs for the purpose for allowing water to drain, none has the same structure as the present invention.

SUMMARY OF THE INVENTION

The objects of the present invention are to provide a new bottom track assembly for sliding doors which:

- allows water to drain easily from a track;
- prevents water from collecting in the tracks while allowing it to drain easily;
- eliminates buildup of algae in the sliding door tracks;
- prevents the build up of dirt between the tracks; and
- provides tracks that need no cleaning.

This invention fulfills the above and other objects by providing a sliding door bottom track assembly which has a plurality of horizontally elongated rigid dividers having means for connecting the dividers at a desired space separation so as to leave an open track between each divider for the sliding doors to slide in the tracks between the dividers. The means for connecting the dividers may comprise circular rods connecting the dividers at spaced intervals. The rods have circular rollers which rotate around the rods when the sliding doors are slid between the tracks. The track assembly is supported on the edge of the shower tub or an outside patio door in such a manner as it allows water and dirt to fall through the tracks into the tub or outside the patio door.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENT

Figure 1:
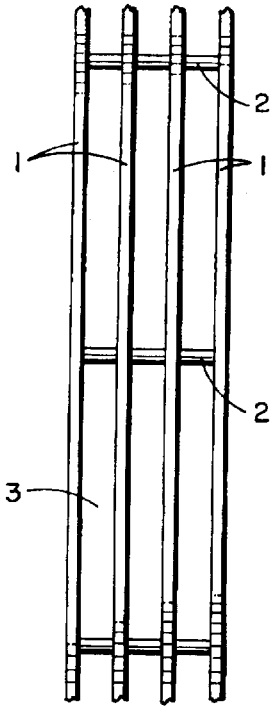
FIG. 1 is a top view of a section of the siding door track assembly of the present invention.
Figure 2:
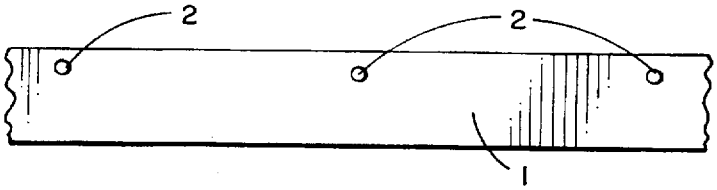
FIG. 2 is a side view of a section of the siding door track assembly of the present invention.
Figure 3:
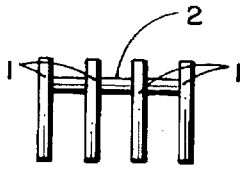
FIG. 3 is an end view of a section of the siding door track assembly of the present invention.

Referring to the drawings, FIGS. 1, 2 and 3 show the bottom track assembly of the present invention. Dividers 1 of the present invention spaced apart from each by connecting rods 2 to leave open space 3 between the dividers 1.

Figure 4:
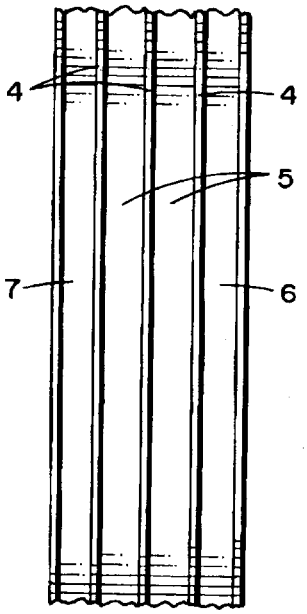
FIG. 4 (PRIOR ART)
FIG. 4 is a top view of a conventional bottom sliding door track assembly of the prior art.
Figure 5:
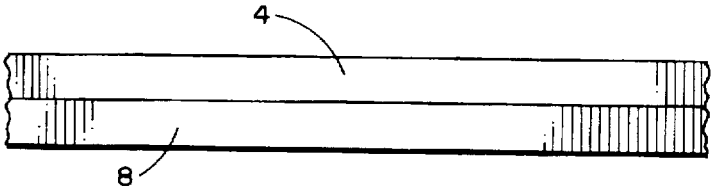
FIG. 5 (PRIOR ART)
FIG. 5 is a side view of a conventional bottom sliding door track assembly of the prior art.
Figure 6:
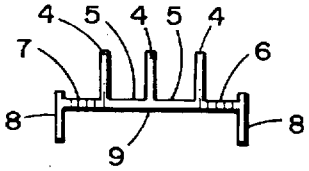
FIG. 6 (PRIOR ART)
FIG. 6 is an end view of a conventional bottom sliding door track assembly of the prior art.

By contrast, conventional bottom shower door track assemblies of the prior art are shown in FIGS. 4, 5 and 6. Conventional shower door tracks utilize conventional track dividers 4 which have solid connecting floors 5 between them which do not allow water of dirt to flow between the dividers 4 except for perhaps for small holes on the bottom side of the dividers which are not illustrated in these drawings. In addition, the bottom sliding door track assemblies of the prior art contain outer shoulders 6 and 7 in which dirt and algae may also buildup and usually supported by support arms 8 attached to a shower tub with the base supporting the shower doors.

Figure 7:
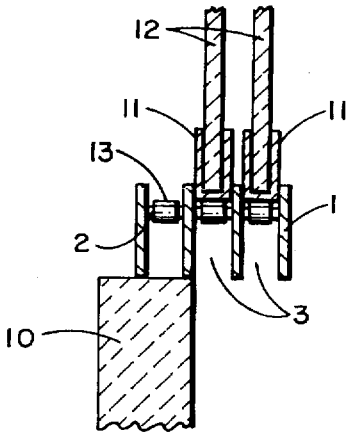
FIG. 7 is an end cross-sectional view of the sliding door track assembly of the present invention being used for shower doors.

The cross sectional view of the sliding door track assembly of the present invention, illustrated in FIG. 7, shows a sliding door base 11 with glass 12 mounted in the tracks 3 between the dividers 1 on circular rollers 13 which rotate around the connecting rods 2 when sliding doors are moved between the tracks 3. This sliding door bottom track assembly is shown mounted on a support base 10.

The bottom track sliding door assembly of the present invention is made of rigid material such as metal, preferably aluminum. Its special construction allows dirt and water to fall through the spaces 3 forming the tracks between the dividers 1. Therefore, algae will not build up in the tracks, such as is the case with conventional bottom sliding door track assemblies.

Although only a preferred embodiment of the present invention has been described in detail hereinabove, all improvements and modifications to this invention within the scope or equivalents of the claims are covered by this invention.

Having thus described my invention, I claim:

1. A bottom track assembly for sliding doors comprising:

a plurality of horizontal elongated rigid dividers having a top edge and a base edge;

a plurality of circular rods for connecting the dividers, said plurality of circular rods being separated by a space to leave an open track between each divider so that dirt and water can fall through the dividers: and wherein the rods have circular rollers which rotate around the rods when the sliding doors are moved between the dividers of the track assembly.

2. The bottom track assembly for sliding doors of claim 1 wherein the rods connecting the dividers are attached near an upper edge of the dividers.

* * * * *